United States Patent [19]

Barbery et al.

[11] 4,118,312

[45] Oct. 3, 1978

[54] PROCESS FOR THE CONCENTRATION BY FLOTATION OF FINE MESH SIZE OR OXIDIZED ORES OF COPPER, LEAD, ZINC

[75] Inventors: Gilles Barbery; Jean-Luc Cecile, both of Orleans, France

[73] Assignee: Bureau de Recherches Geologiques et Minieres, Paris, France

[21] Appl. No.: 750,302

[22] Filed: Dec. 13, 1976

[30] Foreign Application Priority Data

Dec. 15, 1975 [FR] France ..... 75 38393

[51] Int. Cl.[2] ..... B03D 1/14

[52] U.S. Cl. ..... 209/166; 423/26

[58] Field of Search ..... 423/26, 89; 75/2; 209/166, DIG. 4

[56] References Cited

U.S. PATENT DOCUMENTS

| | | | |
|---|---|---|---|
| 2,395,866 | 3/1946 | Gutzeit | 209/166 |
| 3,088,955 | 5/1963 | Foos | 75/2 |
| 3,438,494 | 4/1969 | Fuerstenau et al. | 209/166 |

OTHER PUBLICATIONS

Rinelli et al., "Flotation of Zinc & Lead Oxide–Sulfide Ores with Chelating Agents" in *Tenth International Mineral Processing Congress* (Jones Ed.), Inst. Min & Metall. 1974.

Marcus et al., *Ion Exchange & Solvent Extraction of Metal Complexes,* Wiley–Luterscience, 1969, pp. 502–505.

*Primary Examiner*—Brian Hearn

*Attorney, Agent, or Firm*—Burgess, Dinklage & Sprung

[57] ABSTRACT

The invention relates to the concentration by flotation of fine mesh size and/or oxidized ores.

The invention consists in using a chelating agent selected from the $\beta$-diketones as flotation reagents in a conventional flotation process. Fine mesh size ores and/or oxidized ores, notably oxidized copper, lead or zinc ores with carbonated and/or silicated gangue can also be used as starting materials.

Application:making use as starting materials of ores which are difficult to cause to float by conventional methods.

6 Claims, No Drawings

PROCESS FOR THE CONCENTRATION BY FLOTATION OF FINE MESH SIZE OR OXIDIZED ORES OF COPPER, LEAD, ZINC

The present invention relates to the concentration by flotation of fine mesh size and/or oxidized ores; it relates more particularly to the use of certain chelating agents as flotation reagents.

The concentration of ores by flotation is a technique well known to a man skilled in the art; in this connection reference may be made to the following general treatises: "FROTH FLOTATION" by FUERSTENAU D. W. Society of Mining Engineers 1962 Published by the American Institute of Mining Metallurgical and Petroleum Engineers, "FLOTATION" by A. M. GAUDIN 2nd edition (1957) Mc GRAW HILL Library.

Generally speaking, in a conventional flotation process, the crude ore, that is to say the ore containing the gangue, is crushed and put in suspension in water; the ore suspension is then introduced into the flotation cell with the flotation reagent; said mixture is then agitated and the ore floats to the surface in response to the action of the flotation reagent; other chemical agents such as foaming agents and pH regulators can advantageously be added to the reaction mixture consisting of the aqueous suspension of ore and the flotation reagent.

As currently used flotation reagents may be mentioned xanthates, simple alkylamines and fatty acids. Said flotation reagents are suitable for coarse mesh size ores and notably for sulfurated ores. On the other hand, use of said flotation reagents has been found to be ineffective for the flotation of fine mesh size ores or ores which are difficult to float such as oxidized ores, the latter usually having to be subjected first to sulfuration and only afterwards to the conventional flotation process.

In the present description, the expression "fine mesh size" refers to a mesh size smaller than 20 mμ and "ores which are difficult to float" refers to ores which cannot be treated by conventional flotation processes and notably oxidized ores.

Moreover, use of the liquid-liquid extraction technique to concentrate fine mesh size and/or oxidized ores is not advantageous as it necessitates valuable ore element being first put into an aqueous solution and a leaching step.

Up to now, the industry had more or less given up treating such ores owing to the fact that the processes used for other ores were not applicable to them, or not profitable.

Recently a proposal was made to use certain compounds as flotation reagents in the production of concentrated oxidized copper ore by means of separation by flotation. Said compounds are, for instance, carboxylic amines and the condensation products of polyamines and organic halides; the condensation products of a substituted phenol, an alkylene-diamine and formaldehyde and quaternary hydrocarbylammonium or phosphonium halides (in this connection see FR patent 73 31 627).

It has now been discovered that the use of certain chelating agents as flotation reagents makes it possible to use as a starting product fine mesh size and/or oxidized ores, notably oxidized copper, lead or zinc ores with a carbonated and/or silicated gangue.

In its most general form the object of the present invention is a process for concentration by flotation according to which a suspension of crushed ore is contacted with a flotation reagent, the said suspension is agitated and aerated to cause the ore to float, the said process being characterized by the fact of using as a flotation reagent a chelating agent having a polar portion and a non-polar portion and which complies with the following definitions.

Chelating agents are analytical chemical reagents which act on an ion and not on a mineral particle. For greater detail on these compounds reference may be made to the treatise "Stability constants of metal-ion complexes" by L. G. SILLEN and A. E. MARTELL (Chemical Society Special Publications nos. 17 and 25). All the chelating agents currently used in analytic chemistry are not suited to the requirements of the invention. Chelating agents which may be used as flotation agents, according to the invention, should, as previously mentioned, possess a polar portion which contributes to the formation of the chelate and a non-polar portion which confers the necessary hydrophobic character on the said flotation reagent. While in no way wishing to be limited by any theory the applicants believe that to form the chelate the polar portion of the chelating agent is bound to the surface of the metal ion-bearing ore.

The flotation reagents suitable as chelating agents for the requirements of the invention are beta-diketones of the formula:

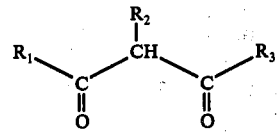

wherein $R_1$ is a lower alkyl group, a phenyl or thiophenyl group; $R_2$ is hydrogen or a lower alkyl group; and $R_3$ is an alkyl group, a phenyl group or a haloalkyl group.

In the present description "lower alkyl group" represents alkyl groups having a maximum of 8 carbon atoms.

As examples of beta-diketones used according to the invention the following compounds may be mentioned:

acetylacetone $R_1 = CH_3—$; $R_2 = H$; $R_3 = CH_3—$ 2,2,6,6-tetramethyl-3,5-heptadione : $R_1 = R_3 = CH_3—C(CH_3)_2—$; $R_2 = H$ benzoyl acetone : $R_1 =$ 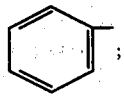 ; $R_2 = H$; $R_3 = CH_3—$ -continued dibenzoyl-methane : $R_1$ = 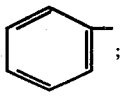 ; $R_2$ = H; $R_3$ = 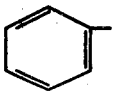

thenoyltrifluoro-acetone : $R_1$ = 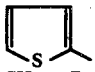 ; $R_2$ = H; $R_3$ = $-CF_3$ 3 methyl-2,4-pentadione : $R_1 = CH_3-$; $R_2 = CH_3-$; $R_3 = CH_3-$
3-acetyl-pentane-2-one : $R_1 = CH_3-$; $R_2 = -CH_2-CH_3$; $R_3 = CH_3-$
3-acetyl-2-hexanone : $R_1 = CH_3-$; $R_2 = CH_3-CH_2-CH_2-$; $R_3 = CH_3-$
6-methyl-2,4-heptadione : $R_1 = CH_3-$; $R_2$ = H; $R_3 = (CH_3)_2CH-CH_2-$
3-acetyl-2-heptanone : $R_1 = CH_3-$; $R_2 = CH_3(CH_2)_2CH_2-$; $R_3 = CH_3-$
3-acetyl-5-methyl-2-hexanone : $R_1 = CH_3-$; $R_2 = (CH_3)_2CH-CH_2-$ $R_3 = CH_3$ Methyl 6 heptadione 2,4

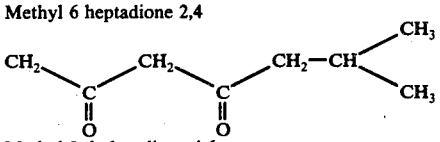

Methyl 2 dodecadione 4,6

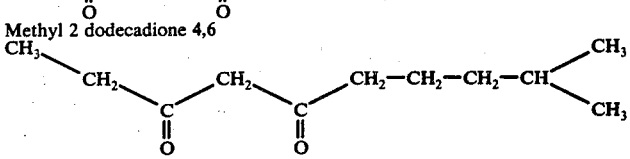

The amounts of flotation reagents used according to the present invention generally lie in the range of about 20 to 300g per ton of ore, and are preferably of about 100 g per ton.

The ore should be crushed, as when the conventional flotation process is carried out, until a maximum amount of mineral contents are released, this crushing rate varies as a function of the mineral content of the ore and can easily be determined by a man skilled in the art as a function of the ore being treated; in the process of the invention excess crushing is also to be avoided, as in conventional flotation.

The flotation reagents of the invention are advantageously used in the form of aqueous solutions. When the reagents used according to the invention are not water-soluble they are first dissolved in an organic solvent. Within the scope of the invention it is in all cases necessary to use an organic solvent which does not have an unfavourable effect on subsequent flotation. For example, it was found that the use of lower aliphatic alcohols considerably reduced the efficiency of the flotation reagent.

According another aspect of the embodiment of the process of the invention, it is advantageous to operate in the presence of a compound making easy the formation of the hydrophobic character of the flotation reagent; it is possible, for example, to use $C_8$–$C_{10}$ alkanes or mixtures thereof, notably such as mineral petroleum or another petroleum derivative; the use of such a compound is particularly advantageous with short chain diketones such as acetylaacetone, with which isooctane, i.e., trimethyl-2,2,4-pentane, is advantageously used.

In the process of the invention, the ore is crushed to a suitable mesh size, then put into suspension in water to form a pulp. The pulp so formed is then introduced into the flotation cell with the flotation reagent in solution, the pH of said solution being adjusted to an exact value in the range of about 5 to 9, and preferably between 6 and 8; this range of pH is particularly advantageous, notably with respect to the apparatus used. The reaction mixture is then agitated and aerated in a conventional manner while maintaining the pH at the value selected within the range of values mentioned hereinabove. The mineral can then be easily recovered from the foams.

The flotation reagents of the invention are selective for certain given metal elements, in contrast to the conventional reagents of the prior technique which necessitated the use of additives, that is to say, depressing agents or activating agents to cause a given mineral to float; for example, in the conventional technique cupric ions are added to float blende; according to the invention, on the contrary, copper or lead ores can be floated selectively. Diketones make it possible to selectively float lead or copper ores.

The invention will be illustrated in greater detail by the following non-limiting examples:

EXPERIMENTAL PROCEDURE

The experimental procedure common to all the examples will first be described.

The tests were effected in a "Hallimond" type tube (small flotation cell) on lg of pure, ground and washed ore. The ores were ground to a mean mesh size adapted to the above experimental apparatus and lying in the range of 100 to 160 mμ.

350 ml of a flotation reagent solution of a given concentration was prepared for each experiment; the pH of said solution was on each occasion adjusted to between 5 to 9 with, for example, sodium hydroxide or perchloric acid.

The temperature of the reagent solution was fixed at about 25°–26° C., putting the solution in a thermostatic bath to maintain said temperature constant.

The reagent solution and the ore in the form of a pulp were then introduced into the flotation cell provided with magnetic agitation; the conditioning time or duration of agitation was fixed at 3 minutes, the pH of the mixture being maintained within the above mentioned range. The mixture was then aerated by bubbling air at a rate of 10 l/hour for 30 seconds. On the one hand, the particles trained with the foams were recovered and, on the other, the residual solid matter; each of these products recovered was weighed after drying and the ratio of the solid mass recovered from the foams to the initial mass was calculated; said ratio shows the recovery rate, designated hereinafter as "%R", these percentages are given to about 5% accuracy.

EXAMPLE 1

A $5.10^{-3}$ M (0.50 g/l) acetylacetone solution was prepared to which was added 0.14 g/l isooctane.

As valuable minerals malachite, cerusite and smithsonite were used and, as a comparison as gangue minerals, calcite and magnesite. The results obtained are given in tables I and II below:

The results given in table II show the selective character of acetylacetone with respect to cerusite to the exclusion of other minerals, in a pH range of 7 to about 8.5

EXAMPLE 2

Two solutions of 2,2,6,6-tetramethyl-3,5-heptadione titering respectively 6.25. $10^{-4}$M (0.100 g/l- solution I-) and 1.25 $\cdot 10^{-4}$ M (0.020 g/l - solution II-) were prepared. The procedure previously described was put into effect with each solution using malachite as the valuable mineral. The results obtained are given in table III below, As a comparison, magnesite was treated under the same conditions.

Tetramethylheptadione is a good flotation reagent for malachite in the pH range of 6.0 to 8.0 even at a low concentration.

EXAMPLE 3

The same solutions were used as in example 2 to treat cerusite and smithsonite according to the procedure previously described. The gangue mineral treated was magnesite.

The results are given in table IV below.

These results show that tetramethylheptadione can be used as a selective collector for lead carbonate in a pH range of from 5.5 to 7.5.

EXAMPLE 4

In this example 6-methyl-2,4-heptadione was used as flotation reagent in the form of a 0.500 g/l aqueous solution. The pH conditions and recovery results are given in table V.

EXAMPLE 5

In this example, methyl-2-dodecadione 4,6 was used as flotation reagent in the form of a 0.100 g/l aqueous solution. The pH conditions and recovery results are given in table VI.

The results of example 4 and 5 show that 6-methyl-2,4-heptadione and 2-methyl-4,6-dodecadione are selective reagents for the flotation of oxidized copper ores with limestone or dolomite gangue.

EXAMPLE 6

12-Methyl-4,6-dodecadione was tested on the artificial malachite (5% of the mass)-dolomite mixture. The ores used were crushed to 100 microns (10 to 20% of 20 microns).

The tests were effected in a 0.3 l laboratory cell on 50g of the mixture (8.5 g of malachite).

The reagent used was a mixture of 2-methyl-4,6-dodecadione 10 g/l, kerosene 10g/l in water; 10 ml of the solution was used, or 2 kg/t; the pH is not controlled ($\approx$ 7.5–8.0).

After three minutes conditioning and the addition of three drops of parafin oil, the cell was aerated (10 l air per hour).

RESULTS

A product of 90% malachite was obtained and 72% of the initial copper ore was recovered.

TABLE I

| pH of cond. | 5.5 | 6.0 | 6.5 | 7.0 | 7.5 | 8.0 | 8.5 | 9.0 | 9.5 | 10.0 | 10.5 |
|---|---|---|---|---|---|---|---|---|---|---|---|
| % R in : | | | | | | | | | | | |
| malachite | 21 | 34 | 35 | 29 | 21 | 15 | 10 | 9 | 6 | 2 | 1 |
| calcite | — | — | — | 6 | 6 | 6 | 5 | 5 | 4 | 2 | 1 |
| magnesite | 9 | 8 | 7 | 6 | 5 | 4 | 3 | 2 | 0 | 0 | 0 |

TABLE II

| pH of cond. | 5.5 | 6.0 | 6.5 | 7.0 | 7.5 | 8.0 | 8.5 | 9.0 | 9.5 | 10.0 | 10.5 |
|---|---|---|---|---|---|---|---|---|---|---|---|
| % R in: | | | | | | | | | | | |
| cerusite | 24 | 30 | 41 | 64 | 72 | 70 | 64 | 22 | 6 | 1 | 0 |
| smithsonite | <10 | <10 | <10 | <10 | <10 | <10 | <10 | <10 | <10 | <10 | <10 |
| calcite | — | — | — | 6 | 6 | 6 | 5 | 5 | 4 | 2 | 1 |
| magnesite | 9 | 8 | 7 | 6 | 5 | 5 | 4 | 2 | 0 | 0 | 0 |

TABLE III

| | pH of cond. | 5.5 | 6.0 | 6.5 | 7.0 | 7.5 | 8.0 | 8.5 | 9.0 | 9.5 | 10.0 | 10.5 |
|---|---|---|---|---|---|---|---|---|---|---|---|---|
| | % R in: | | | | | | | | | | | |
| Solution I | malachite | 91 | 100 | 100 | 100 | 100 | 100 | 95 | 93 | 89 | 85 | 80 |
| | magnesite | 1 | 7 | 11 | 12 | 11 | 10 | 9 | 8 | 6 | 3 | — |
| Solution II | malachite | 44 | 82 | 92 | 89 | 78 | 64 | 25 | 18 | 16 | 15 | — |
| | magnesite | 22 | 27 | 16 | 15 | 20 | 13 | 12 | 11 | 14 | 10 | 10 |

TABLE IV

| | pH of cond. | 5.5 | 6.0 | 6.5 | 7.0 | 7.5 | 8.0 | 8.5 | 9.0 | 9.5 | 10.0 | 10.5 |
|---|---|---|---|---|---|---|---|---|---|---|---|---|
| | % R in: | | | | | | | | | | | |
| Solution I | cerusite | 65 | 56 | 45 | 43 | 45 | 55 | 77 | 55 | 27 | — | — |
| | smithsonite | — | 18 | 15 | 11 | 8 | 22 | — | — | 5 | — | — |
| | magnesite | 1 | 7 | 11 | 12 | 11 | 10 | .9 | 8 | 6 | 3 | — |

TABLE IV-continued

| | pH of cond. | 5.5 | 6.0 | 6.5 | 7.0 | 7.5 | 8.0 | 8.5 | 9.0 | 9.5 | 10.0 | 10.5 |
|---|---|---|---|---|---|---|---|---|---|---|---|---|
| | cerusite | 60 | 59 | 65 | 64 | 55 | 40 | 29 | 20 | 15 | 10 | 6 |
| Solution II | smithsonite | 23 | 21 | 14 | 15 | 12 | 8 | 6 | 3 | 5 | 4 | — |
| | magnesite | 22 | 27 | 16 | 15 | 20 | 13 | 12 | 11 | 14 | 10 | 10 |

TABLE V

| | pH | 5.00 | 6.00 | 7.00 | 8.00 | 9.00 | 10.5 |
|---|---|---|---|---|---|---|---|
| % recovered | calcite | 23 | 19 | 29 | 33 | 50 | 59 |
| | dolomite | 49 | 46 | 51 | 57 | 64 | 57 |
| | quartz | 23 | 22 | 24 | 25 | 22 | 15 |
| | malachite | 100 | 100 | 100 | 100 | 100 | 99 |
| | chrysocolle | 100 | 100 | 100 | 88 | 85 | 63 |

TABLE VI

| | pH | 5.00 | 6.00 | 7.00 | 8.00 | 9.00 | 10.5 |
|---|---|---|---|---|---|---|---|
| % recovered | dolomite | 65 | 59 | 66 | 73 | 73 | 66 |
| | malachite | 100 | 100 | 100 | 100 | 100 | 100 |

What we claim is:

1. In the concentration by flotation of an oxidized ore having a mean mesh size below about 160μm, comprising suspending the ore in an aqueous solution of a flotation reagent, agitating and aerating the suspension whereupon at least a portion of the ore particles floats to the top of the suspension and recovering the floating particles, the improvement which comprises employing as said flotation reagent a beta-diketone selected from the group consisting of acetylacetone, 2,2,6,6-tetramethyl-3,5-heptadione, 6-methyl-2,4-heptadione and 2-methyl-4,6-dodecadione, the pH of the aqueous beta-diketone solution being from about 5 to 9, and said oxidized ore comprising at least one of lead oxide, copper oxide and zinc oxide and at least one of a carbonate and silicate gangue.

2. A process according to claim 1, wherein about 20 to 300 g of the beta-diketone are used per ton of ore.

3. A process according to claim 1, wherein the ore comprises lead oxide and at least one of a carbonate and silicate gangue, and the beta-diketone is acetylacetone or 2,2,6,6-tetramethyl-3,5-heptadione.

4. A process according to claim 1, wherein the ore comprises copper oxide and at least one of a carbonate and silicate gangue, and the beta-diketone is acetylacetone, 2,2,6,6-tetramethyl-3,5-heptadione, 6-methyl-2,4-heptadione or 2-methyl-4,6-dodecadione.

5. A process according to claim 1, wherein about 100 g of beta-diketone are used per ton of ore.

6. A process according to claim 5 wherein the ore has a mean mesh size below about 160 μm and comprises at least one of lead oxide and copper oxide and at least one of a carbonate and silicate gangue, and the pH of the beta-diketone aqueous solution is from about 5 to 9.

* * * * *